US006076955A

United States Patent [19]

Wallther

[11] Patent Number: 6,076,955

[45] Date of Patent: Jun. 20, 2000

[54] METHOD AND AN APPARATUS FOR THE CONTINUOUS MIXING OF TWO FLOWS

[75] Inventor: Bo Wallther, Malmö , Sweden

[73] Assignee: Tetra Laval Holdings & Finance S.A., Pully, Switzerland

[21] Appl. No.: 09/331,202

[22] PCT Filed: Dec. 18, 1997

[86] PCT No.: PCT/SE97/02164

§ 371 Date: Aug. 9, 1999

§ 102(e) Date: Aug. 9, 1999

[87] PCT Pub. No.: WO98/26862

PCT Pub. Date: Jun. 25, 1998

[30] Foreign Application Priority Data

Dec. 19, 1996 [SE] Sweden ..... 9604686

[51] Int. Cl.[7] ..... B01F 15/02

[52] U.S. Cl. ..... 366/163.2; 366/167.1

[58] Field of Search ..... 366/167.1, 174.1, 366/163.2, 163.1, 175.2

[56] References Cited

U.S. PATENT DOCUMENTS

| | | | |
|---|---|---|---|
| 2,424,654 | 7/1947 | Gamble | 366/163.2 |
| 2,563,002 | 8/1951 | Bissell et al. | 366/163.2 |
| 3,332,442 | 7/1967 | Reed | 366/167.1 |
| 4,085,462 | 4/1978 | Booy | 366/173.2 |
| 4,123,800 | 10/1978 | Mazzei | 366/150 |
| 4,448,540 | 5/1984 | McLeod | 366/167.1 |
| 5,176,448 | 1/1993 | King et al. | 366/174.1 |
| 5,810,474 | 9/1998 | Hidalgo | 366/174.1 |

FOREIGN PATENT DOCUMENTS

| | | | |
|---|---|---|---|
| 205 072 | 6/1956 | Australia | 366/167.1 |

*Primary Examiner*—Tony G. Soohoo
*Attorney, Agent, or Firm*—Burns, Doane, Swecker & Mathis, L.L.P.

[57] ABSTRACT

The invention relates to a method and apparatus (1) for continuously mixing two flows (3, 5)., in particular, a first larger flow (3) and a second smaller flow (5). The mixing operation is carried out in a throttle (6) which is placed in the conduit (2) of the first flow. A bent conduit (4) discharges the second flow in the throttle of the conduit. The conduit (4) of the second flow (5) is terminated with a pipe bend (8) and a mouth (9) with a washer (10) such that the two flows (3,5) face towards one another. Additionally, a gap (11) is provided between the washer 10 and the mouth (9) in order to spread the $2^{nd}$ flow uniformly around the mouth (9) of the pipe bend (8) and out into the counter-flowing first flow (3).

6 Claims, 2 Drawing Sheets

Fig. 1
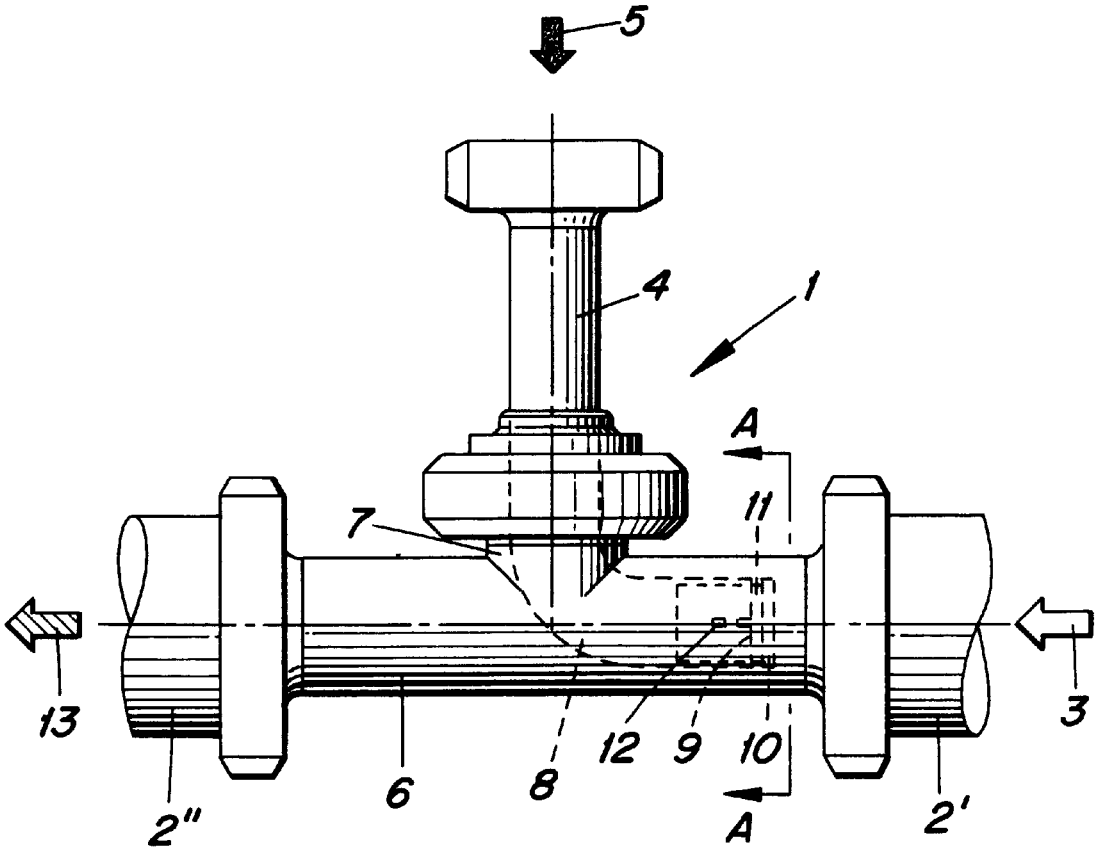
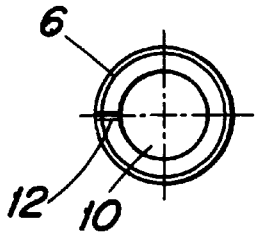
Fig. 2

METHOD AND AN APPARATUS FOR THE CONTINUOUS MIXING OF TWO FLOWS

TECHNICAL FIELD

The present invention relates to a method for mixing two flows, which consist of a first, larger flow and a second, smaller flow. The present invention also relates to an apparatus for carrying the method into effect.

BACKGROUND ART

In the production of drinks such as fruit juices, nectars, still drinks (non-carbonated soft drinks) and the like, the intention is often to mix two or more flows of different characters with one another. Such mixtures may, for instance, consist of a mixture of a juice concentrate with water, sugar solution with a fruit juice, etc. After the mixing operation, the sugar content is measured in the product in Brix with the aid of a refractometer. In order that the Brix value of the product be as reliable as possible, the mixture must be as homogeneous as possible before the product reaches the refractometer.

Mixing can be put into effect in different ways. One method is batchwise mixing in a tank with agitators, this method being both expensive and requiring large areas of space. Another method is that the mixing operation takes place in a so-called static mixer, i.e. the two flows are forced to pass a device where a number of obliquely inclined plates or disks give rise to a turbulence in the flows and thereby a mixing of the flows. However, this method does not give an entirely reliable mixing and, when the flow reaches the refractometer for measuring the Brix value, the results obtained are not wholly satisfactory.

In most countries, juices and nectars have a stipulated minimum Brix value in order to be sold under each respective name. If there is incomplete mixing and thereby an unreliable Brix value in the subsequent measurement, it must be ensured that there is a margin to the lowest permitted Brix value, and this gives rise to increased raw materials costs in the production of specific products.

The flows in a mixing process of the above-described type also have large variations, depending upon the volume of the tanks, pump capacities and the like, for which reason it may be difficult using conventional mixing methods to obtain a reliable and efficient control of the production process.

OBJECTS OF THE INVENTION

One object of the present invention is to realise a method and an apparatus therefor which afford a continuous mixing of two liquid flows which is reliable and efficient.

A further object of the present invention is to obtain such a reliable and homogeneous mixing of the two flows that it is possible to control production in such a manner that this positively influences the consumption of raw materials in production, which substantially reduces costs.

SOLUTION

These and other objects have been attained according to the present invention in that the method and the apparatus of the type described by way of introduction have been given the characterizing feature that the mixing is carried out where the first flow passes a throttle and the second flow is introduced into the throttle in a direction opposite to the first flow.

Preferred embodiments of the present invention have further been given the characterizing features as set forth in the appended subclaims.

BRIEF DESCRIPTION OF THE ACCOMPANYING DRAWINGS

One preferred embodiment of the present invention will now be described in greater detail hereinbelow with reference to the accompanying Drawings, in which:

FIG. 1 shows a side elevation of the apparatus according to the invention;

FIG. 2 is a section taken along the line A—A in FIG. 1; and

DESCRIPTION OF PREFERRED EMBODIMENTS

Figure 3:
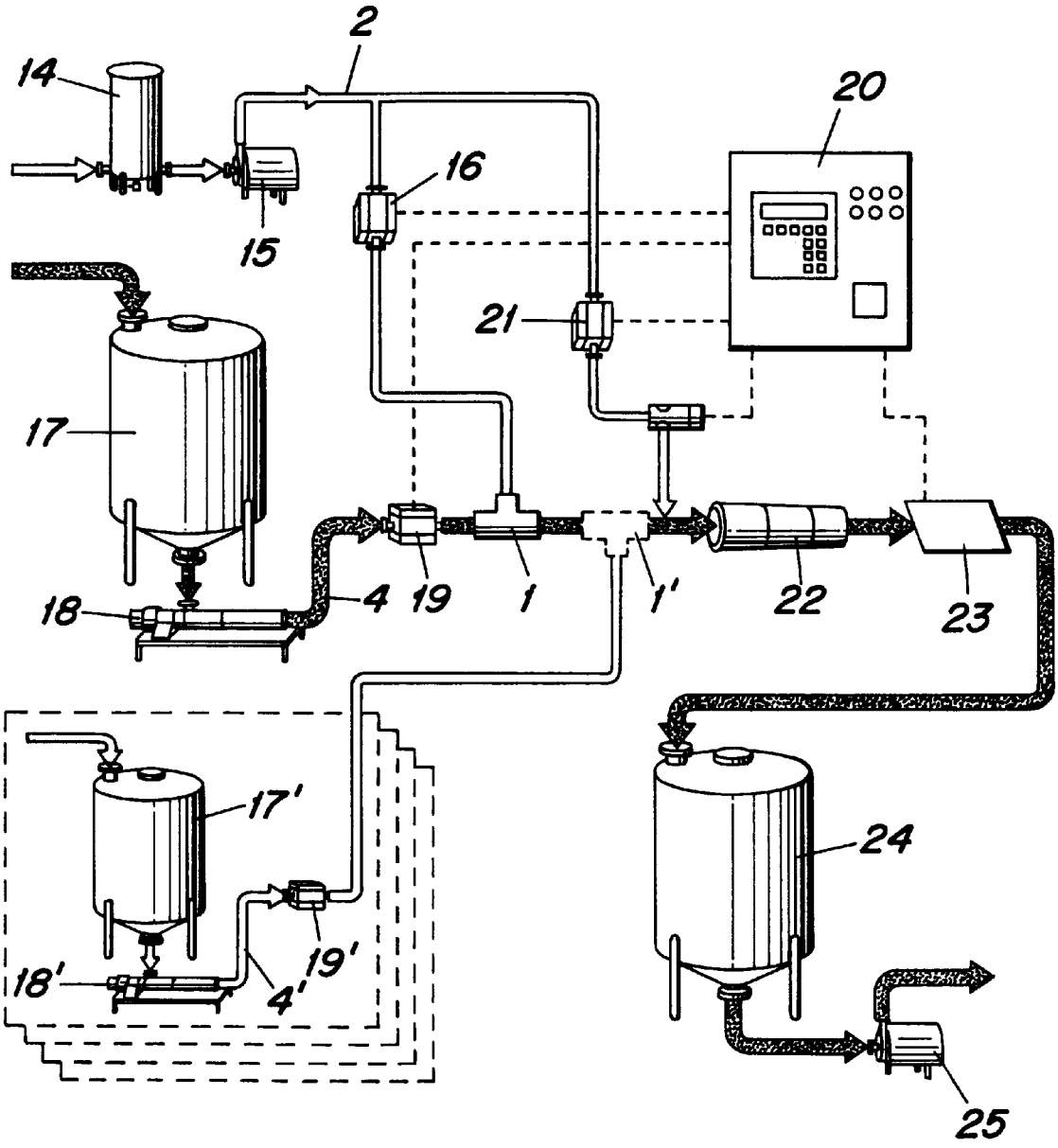
FIG. 3 shows a flow diagram with one or more apparatuses according to the present invention.

FIG. 1 shows the apparatus I which consists of a conduit 2 for a first flow 3 and a conduit 4 for a second flow 5. The present invention presupposes that the first flow 3 is larger than the second flow 5.

In the conduit 2 for the first, larger flow 3, there is disposed a throttle 6, i.e. a section of the conduit 2 is of smaller diameter than the standard conduit 2. A branch pipe 7 is disposed in this throttle 6 in which branch pipe the conduit 4 for the second, smaller flow 5 may be connected.

The conduit 4 for the second, smaller flow 5 has, in its turn a smaller diameter than the throttle 6. The conduit 4 for the second flow 5 discharges in the throttle section 6 with a pipe bend 8, the pipe bend 8 being oriented such that the second, smaller flow 5 discharges in a direction which is opposed to that of the first, larger flow 3.

A washer 10 is placed ahead of the mouth 9 of the pipe bend 8, the washer being secured in the pipe bend 8 such that a gap 11 occurs between the mouth 9 of the pipe bend 8 and the washer 10. The purpose of the gap is to spread the second flow 5 when it meets the first flow 3, which gives an efficient and rapid mixing of both of the flows 3, 5. The gap 11 is adapted such that it is approx. 3 mm. A larger gap gives a poorer mixing of the two flows 3, 5 and a smaller gap would require greater pumping capacity to convey the second, smaller flow 5. The width of the gap 11 should also be selected that any possible fibres or fruit flesh pieces in a fruit juice concentrate do not fasten between the mouth 9 and the washer 10.

At the mouth 9 of the pipe bend 8, there is also disposed a centring heel 12 which centres the pipe bend 8 in the throttle 6. By centring the pipe bend 8, a more uniform and reliable mixing will be obtained around the whole of the mouth 9 of the pipe bend 8.

The diameters of the two conduits 2, 4 and the throttle 6 are selected in view of the different flows 3, 5 which the intention is to mix in the apparatus 1. It is further desirable to select standard dimensions, since special pipes would considerably increase the costs of the installation. In a first preferred embodiment, the conduit 2 selected for the first, larger flow 3 is selected at a standard diameter of Ø 63 mm, the throttle 6 is selected such that its cross sectional area constitutes approx. ⅓ of the cross sectional area of the conduit 2, which implies a standard diameter Ø 38 mm. The conduit 4 for the second, smaller flow 5 is selected such that its cross sectional area constitutes <⅙ of the cross sectional area of the conduit 2. Thus, the conduit 4 may be designed with a standard diameter of Ø 25 mm. Experiments have demonstrated that this first preferred embodiment caters for difficult mixing conditions, such as frozen (−5° C.) concentrated orange juice which is to be nixed with cold water.

For less severe mixing conditions, such as, for example, the mixing of diluted fruit juice with a sugar solution, use may be made of the second preferred embodiment of the invention. This implies that the conduit 2 for the first, larger flow is of the standard diameter of Ø 63 mm. The throttle 6 is selected such that its cross sectional area constitutes approx. ⅔ of the cross sectional area of the conduit 2, which implies a standard diameter of Ø 51 mm. The conduit 4 for the second, smaller flow 5 is selected with a cross sectional area which constitutes approx. ⅓ of the cross sectional area of the conduit 2, which implies that the conduit 4 is designed with a standard diameter of Ø 38 mm.

In the first conduit 2', the first larger flow 3 enters. This flow 3 may be water or the like and it is always the largest component in the mixture. The flow 3 reaches the throttle 6, which results in the speed of the flow 3 increasing at the same time as the flow 3 meets the second, smaller flow 5 which is led into the throttle 6 through the branch pipe 7 and out through the mouth 9 of the pipe bend 8. The gap 11 between the mouth 9 of the pipe bend 8 and washer 10 results in the second flow 5 being spread uniformly around the mouth of the pipe bend 8 and out into the counter-flowing first flow 3, so that there will be obtained an efficient and homogeneous mixing of the two flows 3, 5. The mixed flow 13 departs from the throttle and passes further in the conduit 2".

FIG. 3 shows the apparatus 1 in a standard plant or installation for producing, for example, fruit juices, nectars, still drinks and sports drinks. Via a balance tank 14, water is pumped by means of a pump 15 into the conduit 2 of the installation. In the standard installation, water constitutes the first, larger flow 3. A flow meter meters the water flow which is conveyed into the apparatus 1 according to the present invention.

A flow of concentrate into the installation constitutes the second, smaller flow 5 and, via a balance tank 17 and a pump 18, this flow 5 is conveyed further to a flow meter 19 and into the apparatus 1.

The flow meters 16 and 19 govern, via a control panel, the mixing process, and a further flow meter 21 adjusts the pre-set Brix value by a possible addition of extra water. After this possible correction, the mixture passes through a static mixer 22 and moves further to a refractometer 23 where the exact Brix value of the mixture is measured and registered in the control panel 20. By continuous monitoring via the refractometer 23 and flow meters 16, 19, 21, there will be obtained an exact and reliable mixture and which ensures that the desired Brix value of the mixture is maintained.

Before the ready-mixed product departs from the installation, it may possibly pass through a buffer tank 24 before, via a pump 25, being pumped further for possible additional processing and to final filling into consumer packages.

By coupling-in a plurality of apparatuses 1 into the installation, it is possible to add to the first flow 3 further second flows 5 such as additional fruit concentrate, sugar solution, vitamin solution and the like. The additional apparatuses 1 with their flows 5 are shown by means of broken lines in FIG. 3.

As will have been apparent from the foregoing description, the present invention realises an apparatus 1 which is simple, economical and requires little space, at the same time as it ensures an efficient and reliable mixing process which, by flow meters 16, 19, 21 and a refractometer 23, may be governed such that a uniform quality of the mixture is obtained, with a pre-set Brix value.

The present intention should not be considered as restricted to that described above and shown on the Drawings, many modifications being conceivable without departing from the scope of the appended Claims.

What is claimed is:

1. A method for continuous mixing two flows (3, 5), which consist of a first, larger flow (3) and a second, smaller flow (5), characterized in that the mixing is carried out when the first flow (3) passes a throttle (6); and that the second flow (5) is fed into the throttle (6) in a direction opposite to that of the first flow (3).

2. An apparatus (1) for continuously mixing two flows (3, 5), with an incoming conduit (29 for the first, larger flow (3) and an incoming conduit (4) for the second, smaller flow (5), characterized in that the first conduit (2) passes a throttle (6) in which throttle (6) the second conduit (4) discharges by means of a pipe bend (8) disposed such that the two flows (3, 5) face towards one another.

3. The apparatus (1) as claimed in claim 2, characterized in that a washer (10) is disposed ahead of the mouth (9) of the pipe bend (8) such that a gap (11) is formed between the mouth (9) and the washer (10).

4. The apparatus (1) as claimed in claim 2, characterized in that the pipe bend (8) is centred in the throttle (6) by means of a centering heel (12).

5. The apparatus (1) as claimed in any of claim 2, characterized in that the cross sectional area of the throttle (6) constitutes approx. ⅓ of the cross sectional area of the first conduit (2); and that the cross sectional area of the second conduit (4) constitutes <⅙ of the cross sectional area of the first conduit (2).

6. The apparatus (1) as claimed in claim 2, characterized in that the cross sectional area of the throttle (6) constitutes approx. ⅔ of the cross sectional area of the first conduit (2); and that the cross sectional area of the second conduit (4) constitutes approx. ⅓ of the cross sectional area of the first conduit (2).

* * * * *